US008297795B2

(12) United States Patent
Huang

(10) Patent No.: US 8,297,795 B2
(45) Date of Patent: Oct. 30, 2012

(54) ILLUMINATING APPARATUS HAVING LIGHT SHELTERS ON TUBULAR SIDEWALL

(75) Inventor: Chien-Feng Huang, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 359 days.

(21) Appl. No.: 12/753,090

(22) Filed: Apr. 1, 2010

(65) Prior Publication Data

US 2010/0254143 A1 Oct. 7, 2010

(30) Foreign Application Priority Data

Apr. 3, 2009 (CN) ..... 2009 1 0301340

(51) Int. Cl.
*F21S 8/00* (2006.01)
*F21V 17/02* (2006.01)

(52) U.S. Cl. ..... 362/277; 362/319; 362/321

(58) Field of Classification Search ..... None
See application file for complete search history.

(56) References Cited

U.S. PATENT DOCUMENTS 5,904,417 A * 5/1999 Hewett ..... 362/321

FOREIGN PATENT DOCUMENTS

| | | | |
|---|---|---|---|
| CN | 2754312 | Y | 1/2006 |
| CN | 201141551 | Y | 10/2008 |
| KR | 10-2009-0017941 | A | 2/2009 |

* cited by examiner

*Primary Examiner* — Anh Mai
*Assistant Examiner* — Britt D Hanley
(74) *Attorney, Agent, or Firm* — Altis Law Group, Inc.

(57) ABSTRACT

An illuminating apparatus includes a lamp shade, a light source and a plurality of light shelters. The lamp shade includes a tubular sidewall, a receiving space and an opening. The light source is received in the receiving space. The plurality of light shelters is mechanically pivoted on the tubular sidewall. The plurality of light shelters is capable of being respectively and selectively rotated to cover the opening, thereby sheltering light passing through the opening.

6 Claims, 4 Drawing Sheets

ILLUMINATING APPARATUS HAVING LIGHT SHELTERS ON TUBULAR SIDEWALL

BACKGROUND

1. Technical Field

The present disclosure generally relates to illuminating apparatus, and particularly, to an illuminating apparatus whose light intensity and field are adjustable by manipulating foldable light shelters of the apparatus.

2. Description of Related Art

In the design of an illuminating apparatus, light field and intensity are always major concerns. Most illuminating apparatuses generally generate butterfly-type light fields or diffusion-type light fields. However, these types of light field are not always suitable for a particular application, for example, a three-dimensional, microscopic examination of an article, which may require the light field of the illuminating apparatus to be changeable. Furthermore, in such application, the light intensity generated by the illuminating apparatus is also required to be changeable.

Therefore, what is needed is to provide an illuminating apparatus whose light field and intensity are adjustable.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views, and all the views are schematic.

DETAILED DESCRIPTION

Reference will now be made to the drawings to describe various embodiments of the present illuminating apparatus, in detail.

Figure 1:
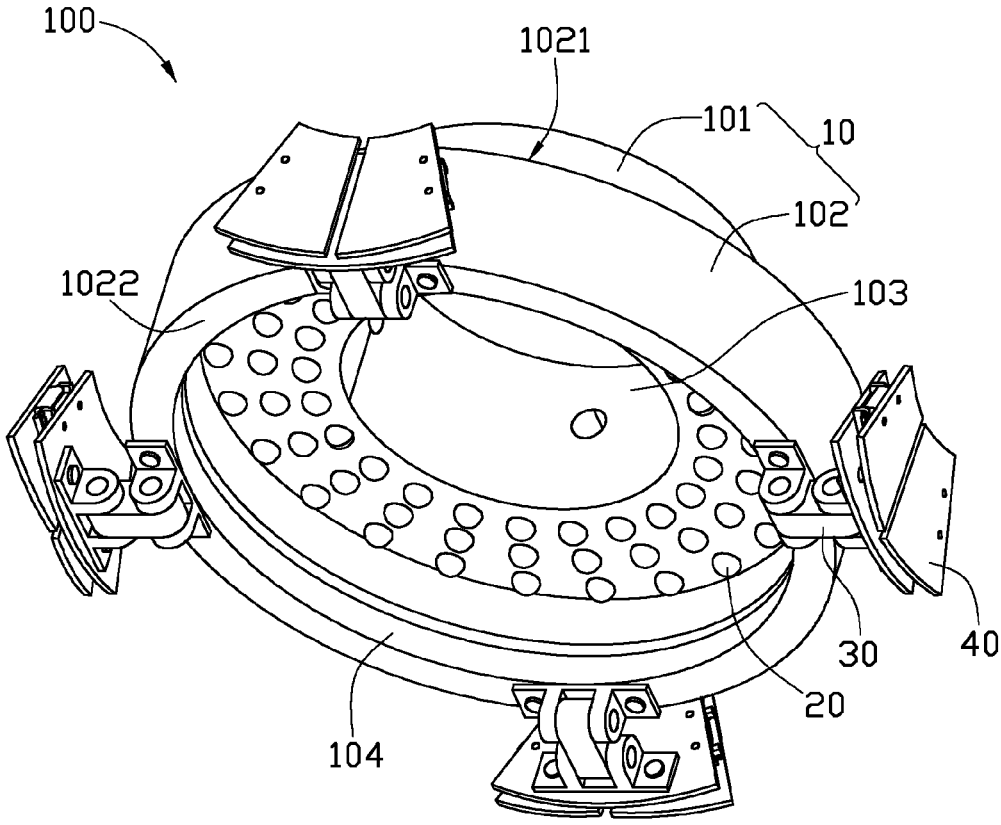
FIG. 1 is an isometric view of an illuminating apparatus in accordance with an embodiment of the present disclosure.

Referring to FIG. 1, an illuminating apparatus 100, according to an exemplary embodiment, includes a lamp shade 10, a light source 20, four first pivot devices 30 and four light shelters 40.

The lamp shade 10 includes a roof 101 and a tubular sidewall 102. The tubular sidewall 102 includes two opposite end surface 1021, 1022 at a longitudinal direction thereof. The roof 101 seals the tubular sidewall 102 at the end surface 1021. An opening 104 is remained in the end surface 1022. The roof 101 and the tubular sidewall 102 cooperatively form a receiving space 103, which communicates with the outer environment via the opening 104.

The light source 20 is received in the receiving space 103. Light emitted from the light source 20 can be extracted out of the receiving space 103 via the opening 104. In this embodiment, the light source 20 includes a plurality of light emitting diodes (LEDs) arranged in the receiving space 103. The light source 20 can also include a fluorescent lamp, an incandescent lamp, a gas discharge lamp, a halogen lamp or combination thereof.

The first pivot devices 30 are arranged on the end surface 1022 uniformly along a circumferential direction thereof.

The light shelters 40 are mechanically connected to the tubular sidewall 102 by pivot engagements with the first pivot devices 30 in one-to-one relationship.

Figure 2:
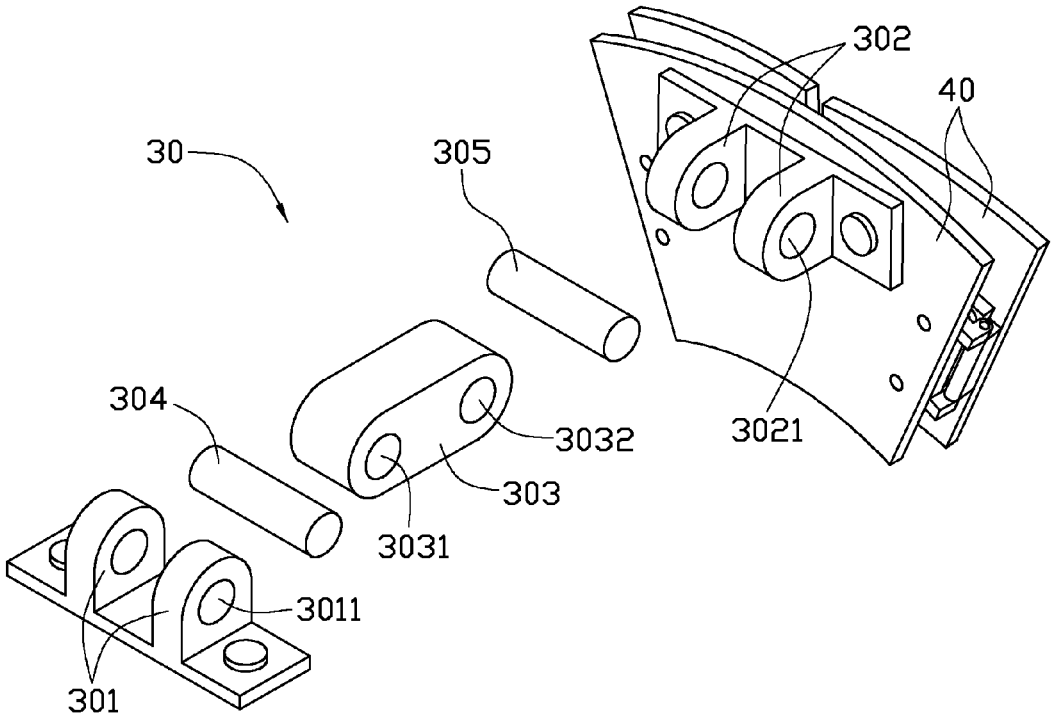
FIG. 2 is an exploded view of a light shelter and a first pivot device of the illuminating apparatus of FIG. 1.

Referring to FIG. 2, each first pivot device 30 includes two first fixed portions 301, two second fixed portions 302, a connecting portion 303, a first shaft pin 304 and a second shaft pin 305.

The two first fixed portions 301 are fixed on the end surface 1022 and opposite to each other. Each first fixed portion 301 includes a first through hole 3011, and the two first through holes 3011 face towards and align with each other.

The two second fixed portions 302 are fixed on one of the light shelters 40. Each second fixed portion 302 includes a second through hole 3021, and the two second through holes 3021 face towards and align with each other.

The connecting portion 303 includes a third through hole 3031 and a fourth through hole 3032 at opposite ends thereof.

The first shaft pin 304 penetrates, in succession, through the first through hole 3011 of one first fixed portion 301, the third through hole 3031 of the connecting portion 303 and the first through hole 3011 of the other first fixed portion 301, thereby forming a pivot engagement between the first fixed portions 301 and the connecting portion 303.

The second shaft pin 305 penetrates, in succession, through the second through hole 3021 of one second fixed portion 302, the fourth through hole 3032 of the connecting portion 303 and the second through hole 3021 of the other second fixed portion 302, thereby forming a pivot engagement between the second fixed portions 302 and the connecting portion 303.

As such, the light shelter 40 is mechanically connected to the tubular sidewall 102 by the first pivot device 30. The light shelter 40 is capable of being rotated around a longitude axis of the second shaft pin 305. The connecting portion 303 and the light shelter 40 are capable of being rotated together around a longitude axis of the first shaft pin 304. Therefore, each of the light shelters 40 can be rotated to the opening side of the tubular sidewall 102 and cover a corresponding section of the opening 104. As such, light emitted from the light source 20 and passing through the opening 104 can be selectively sheltered by rotating selected one(s) of the light shelters 40.

Figure 3:
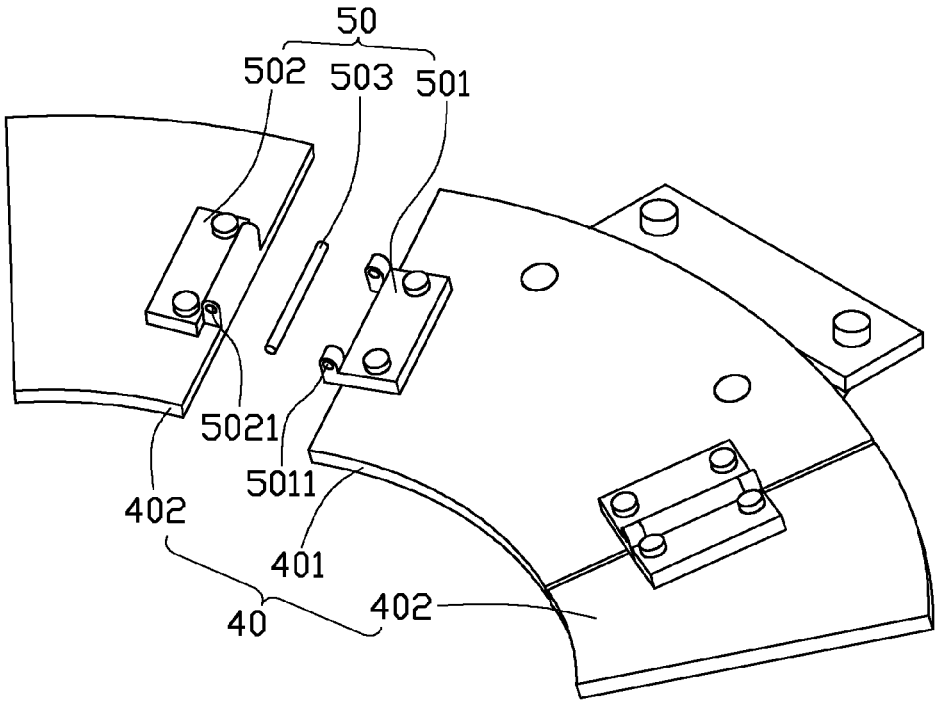
FIG. 3 is an exploded view of a first light sheltering portion, a second light sheltering portion and a second pivot device of the illuminating apparatus of FIG. 1.

Referring to FIG. 3, the light shelters 40 each includes a first sheltering portion 401 and two second sheltering portions 402. The first sheltering portion 401 and the second sheltering portions 402 each have a shape of a sectorial plate with an arced inner edge. The two second sheltering portions 402 each are mechanically connected to one of two lateral sides of the first sheltering portion 401 by pivot engagement with a respective second pivot device 50.

The second pivot device 50 includes a third fixed portion 501, a fourth fixed portion 502 and a third shaft pin 503.

The third fixed portion 501 is fixed at the lateral side of the first sheltering portion 401. The third fixed portion 501 includes two fifth through holes 5011 facing towards and aligning with each other.

The fourth fixed portion 502 is fixed at an edge of the second sheltering portion 402. The fourth fixed portion 502 includes a sixth through hole 5021.

Figure 4:
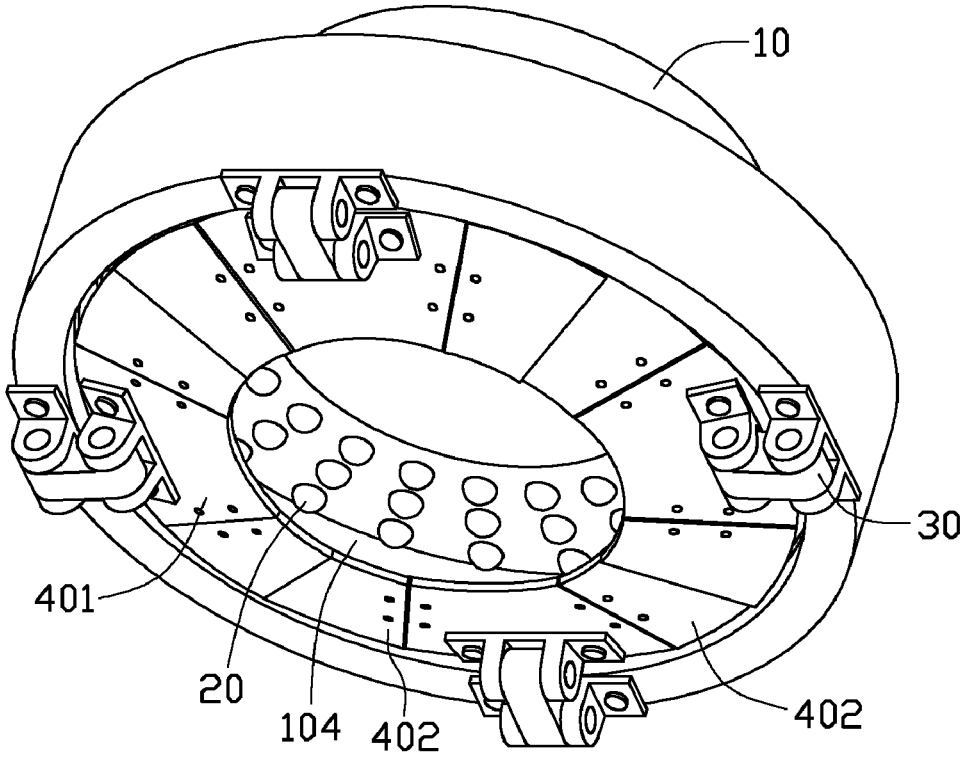
FIG. 4 is a view similar to FIG. 1, with four light shelters of the apparatus all moved to a sheltering position.

The third shaft pin 503 penetrates, in succession, through one fifth through hole 5011 of the third fixed portion 501, the sixth through hole 5021 of the fourth fixed portion 502 and the other fifth through hole 5011 of the third fixed portion 501, thereby forming a pivot engagement between the third fixed portion 501 and the fourth fixed portion 502. The second sheltering portion 402 is capable of being rotated around a longitude axis of the third shaft pin 503. Therefore, the two second sheltering portions 402 can be rotated to a position over the first sheltering portion 401 so that the light shelter 40 has a half sheltering area as shown in FIG. 1. Alternatively, the two second sheltering portions 402 can be rotated to a position that they are coplanar with and at the lateral sides of the first sheltering portion 401 so that the light shelter 40 has a whole sheltering area as shown in FIG. 4. Moreover, it is understood by a person skilled in the art that it is also possible that only one of the two sheltering portions 402 is folded to be located over the first sheltering portion 401 so that the light shelter 40 has a three-fourths sheltering area.

It is to be said that, in this embodiment, the four light shelters 40 each has a shape of a sector and all of the four light shelters 40 are capable of cooperatively forming an annular shape when they are fully extended and moved to cover the opening 104 of the tubular sidewall 102. The illuminating apparatus 100 is no limited to include only four light shelters 40, the amount of the light shelters 40 can also be two, three, five or more. Further, the first pivot devices 30 are not limited to be arranged on the end surface 1022. The first pivot device 30 can also be configured at other places of the tubular sidewall 102.

In the above-described illuminating apparatus 100, the light shelters 40 are mechanically connected to the tubular sidewall 102 by pivot engagements and rotatable relative to the tubular sidewall 102. Therefore, the light shelters 40 can be selectively rotated to cover part/all of the opening 104 of the tubular sidewall 102, and shelter light transmitted via the corresponding area of the opening 104. Thereby, a predetermined light field can be formed by light which is not sheltered. In addition, the light intensity can be adjusted by selectively moving the light shelters 40 to cover the opening 104.

Finally, it is to be understood that the above-described embodiments are intended to illustrate rather than limit the disclosure. Variations may be made to the embodiments without departing from the spirit of the invention as claimed. The above-described embodiments illustrate the scope of the disclosure but do not restrict the scope of the disclosure.

What is claimed is:

1. An illuminating apparatus, comprising:

a lamp shade with a tubular sidewall, a receiving space in the tubular side wall and an opening near an end of the tubular side wall and communicating with the receiving space which is located inside of the opening;

a light source received in the receiving space; and a plurality of light shelters mechanically pivoted on the tubular sidewall, wherein the plurality of light shelters are capable of being respectively and selectively rotated to cover the opening, thereby sheltering light generated by the light source and passing through the opening;

wherein the plurality of light shelters each comprise a first sheltering portion and a second sheltering portion pivotably connected to a lateral side of the first sheltering portion.

2. The illuminating apparatus according to claim 1, further comprising a roof, wherein the tubular sidewall comprising two opposite end surfaces, the roof sealed the tubular sidewall at one of the end surfaces, and the opening is adjacent to the other end surface.

3. The illuminating apparatus according to claim 1, wherein the light shelters each have a shape of a sector.

4. The illuminating apparatus according to claim 1, wherein the second sheltering portion is pivoted on the first sheltering portion by a second pivot device, the second pivot comprises a third fixed portion fixed on the first sheltering portion, a fourth fixed portion fixed on the second sheltering portion, and a third shaft pin pivotably connecting the fourth fixed portion to the third fixed portion.

5. The illuminating apparatus according to claim 4, wherein the third fixed portion and the fourth fixed portion each comprise a third through hole, the third shaft pin penetrates the third through holes of the third fixed portion and the fourth fixed portion and forms a pivot engagement therebetween.

6. The illuminating apparatus according to claim 1, wherein the first sheltering portion and the second sheltering portion each have a shape of a sector.

* * * * *